US011712788B2

(12) United States Patent
Liao et al.

(10) Patent No.: US 11,712,788 B2
(45) Date of Patent: Aug. 1, 2023

(54) OIL FILTER REMOVAL TOOL

(71) Applicant: KTL INTERNATIONAL CO., LTD., Taichung (TW)

(72) Inventors: Ying-Chieh Liao, Taichung (TW); Yu-Kuo Liao, Taichung (TW)

(73) Assignee: KTL INTERNATIONAL CO., LTD., Taichung (TW)

( * ) Notice: Subject to any disclaimer, the term of this patent is extended or adjusted under 35 U.S.C. 154(b) by 125 days.

(21) Appl. No.: 17/372,117

(22) Filed: Jul. 9, 2021

(65) Prior Publication Data

US 2023/0009168 A1 Jan. 12, 2023

(51) Int. Cl.
*B25B 27/00* (2006.01)

(52) U.S. Cl.
CPC ..... *B25B 27/0042* (2013.01)

(58) Field of Classification Search
None
See application file for complete search history.

(56) References Cited

U.S. PATENT DOCUMENTS 4,020,922 A * 5/1977 Klasel ..... B01D 35/31 383/106
4,376,703 A * 3/1983 Krauss ..... B01D 35/31 220/737
5,271,299 A * 12/1993 Wadsworth ..... F16N 33/00 7/100
2012/0198970 A1* 8/2012 Robidoux ..... B01D 35/31 81/121.1

* cited by examiner

*Primary Examiner* — Brian D Keller
(74) *Attorney, Agent, or Firm* — Muncy, Geissler, Olds & Lowe, P.C.

(57) ABSTRACT

An oil filter removal tool configured for removal of a filter cartridge is provided, including: a main body, including a driving portion configured to be connected with a driven portion of the filter cartridge so that the main body is rotatable with the filter cartridge; a cover portion, connected with the main body, including an opening corresponding to the driving portion, the opening being configured for assembling of the driven portion of the filter cartridge therewithin; wherein the main body has a first flexibility, the cover portion has a second flexibility, and the second flexibility is greater than the first flexibility.

6 Claims, 5 Drawing Sheets

OIL FILTER REMOVAL TOOL

BACKGROUND OF THE INVENTION

Field of the Invention

The present invention relates to an oil filter removal tool.

Description of the Prior Art

Nowadays, in the automobile industry, the filter is designed that it only needs to replace the internal filtering element. The filter cartridge is screwed to the vehicle to accommodate and position the filtering element. In this way, it only needs to unscrew the filter cartridge to replace the filtering element.

The conventional filter removal tool is made of rigid metal material, so during uninstallation of the filter, there is a gap between the filter removal tool and the vehicle, and the oil can leak via the gap, which can contaminate hands or tools for removing the filter.

The present invention is, therefore, arisen to obviate or at least mitigate the above-mentioned disadvantages.

SUMMARY OF THE INVENTION

The main object of the present invention is to provide an oil filter removal tool which is good in preventing leakage.

To achieve the above and other objects, an oil filter removal tool configured for removal of a filter cartridge is provided, including: a main body, including a driving portion configured to be connected with a driven portion of the filter cartridge so that the main body is rotatable with the filter cartridge; a cover portion, connected with the main body, including an opening corresponding to the driving portion, the opening being configured for assembling of the driven portion of the filter cartridge therewithin; wherein the main body has a first flexibility, the cover portion has a second flexibility, and the second flexibility is greater than the first flexibility.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
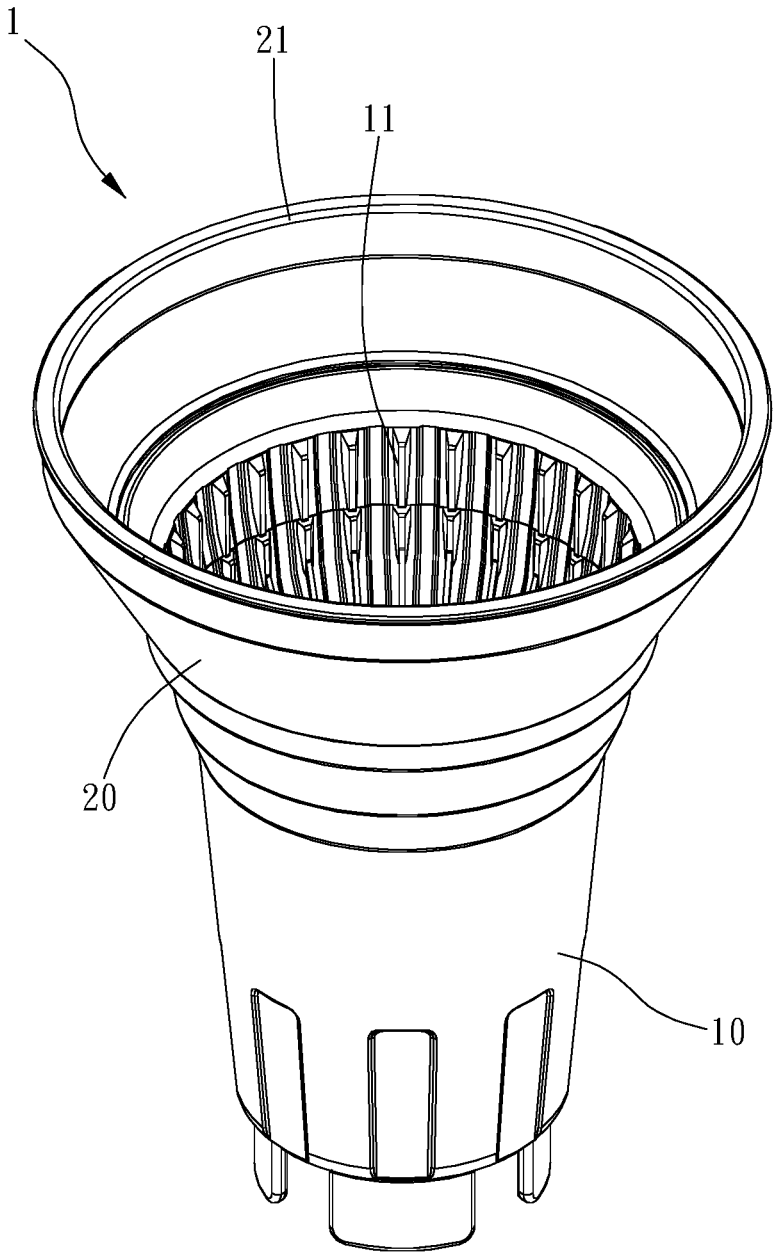
FIG. 1 is a stereogram of a preferable embodiment of the present invention.
Figure 2:
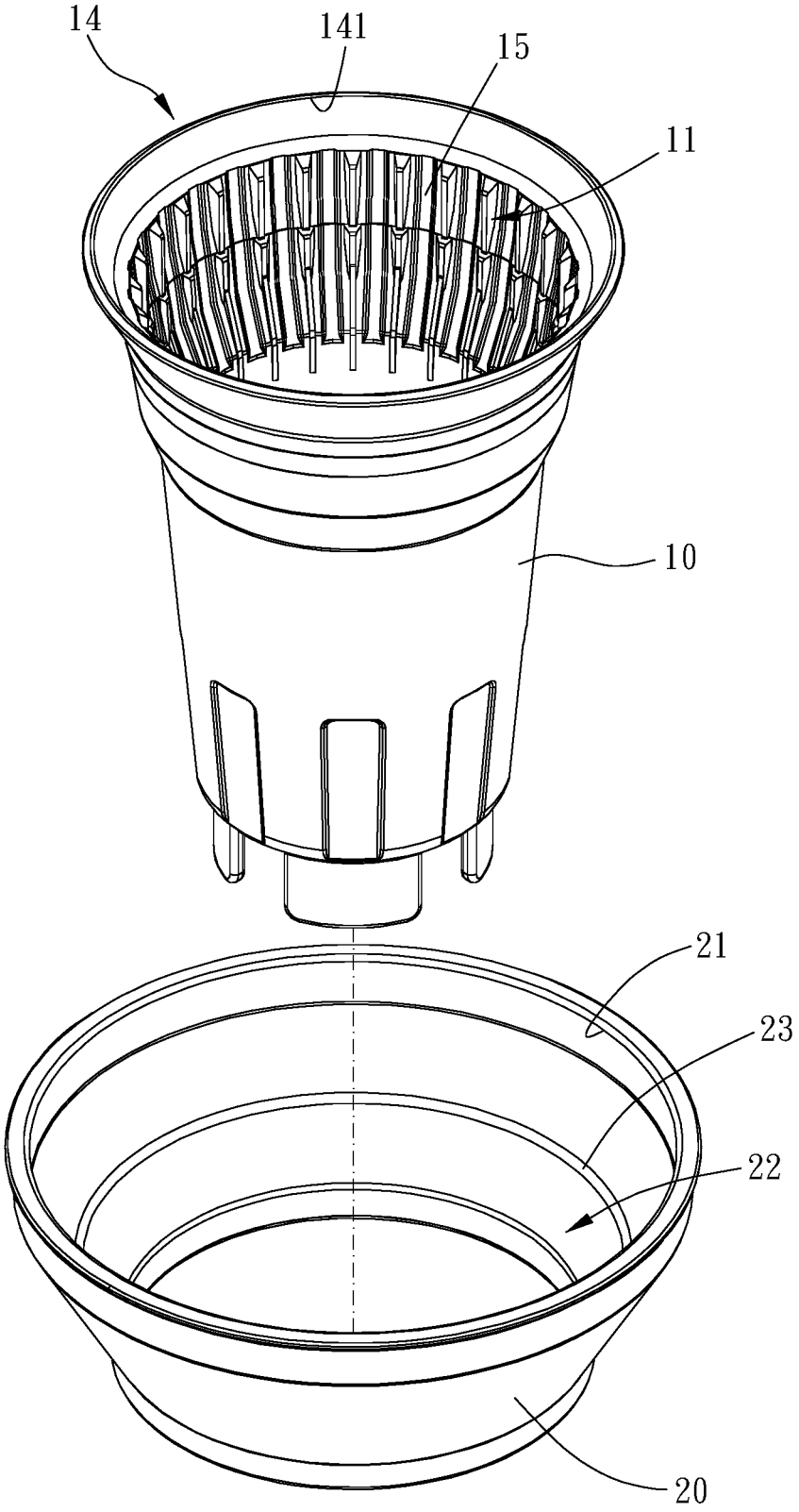
FIG. 2 is a breakdown drawing of a preferable embodiment of the present invention.
Figure 3:
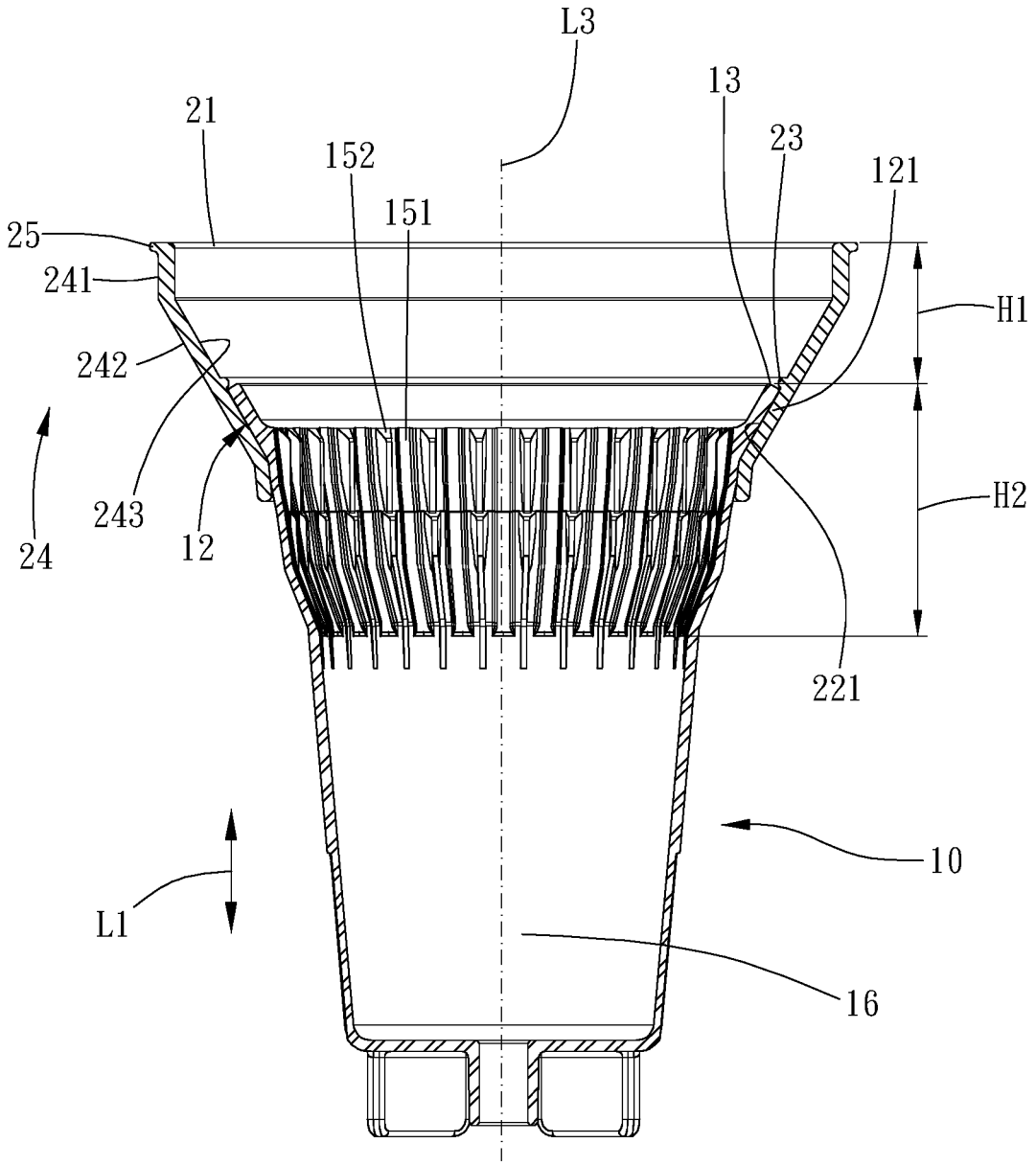
FIG. 3 is a cross-sectional view of a preferable embodiment of the present invention.
Figure 4:
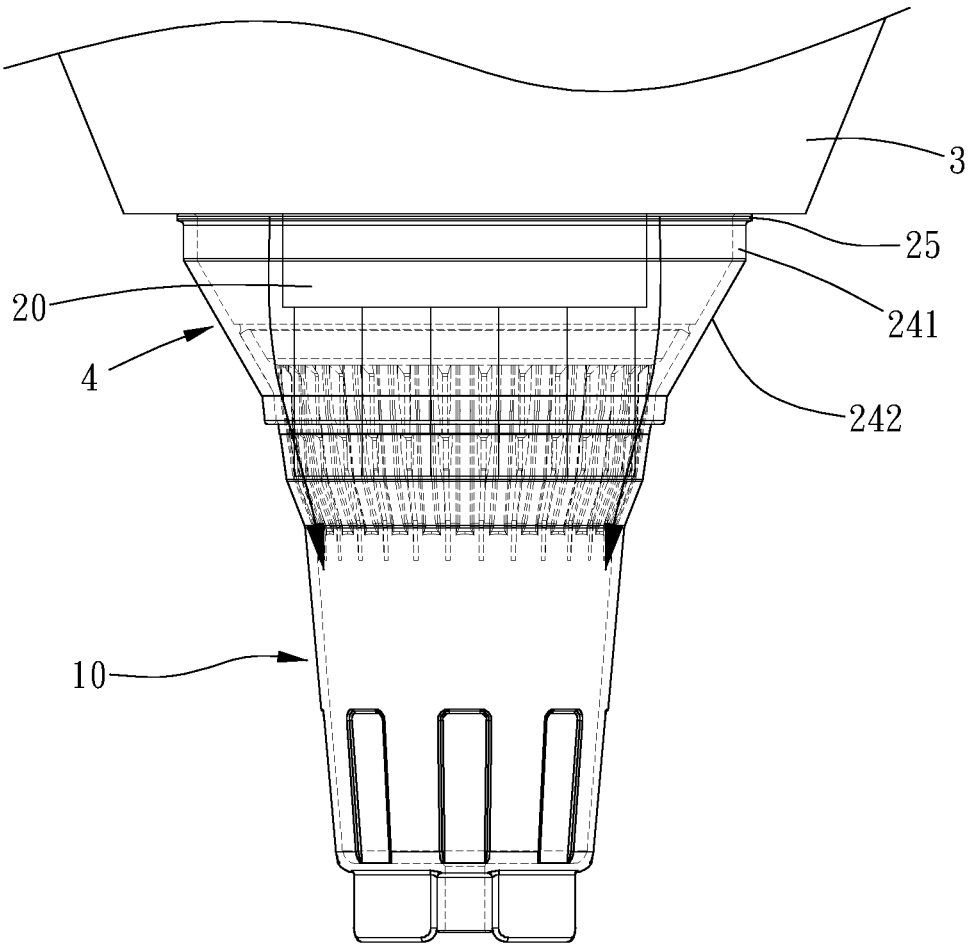
FIG. 4 is a drawing showing application of a preferable embodiment of the present invention.
Figure 5:
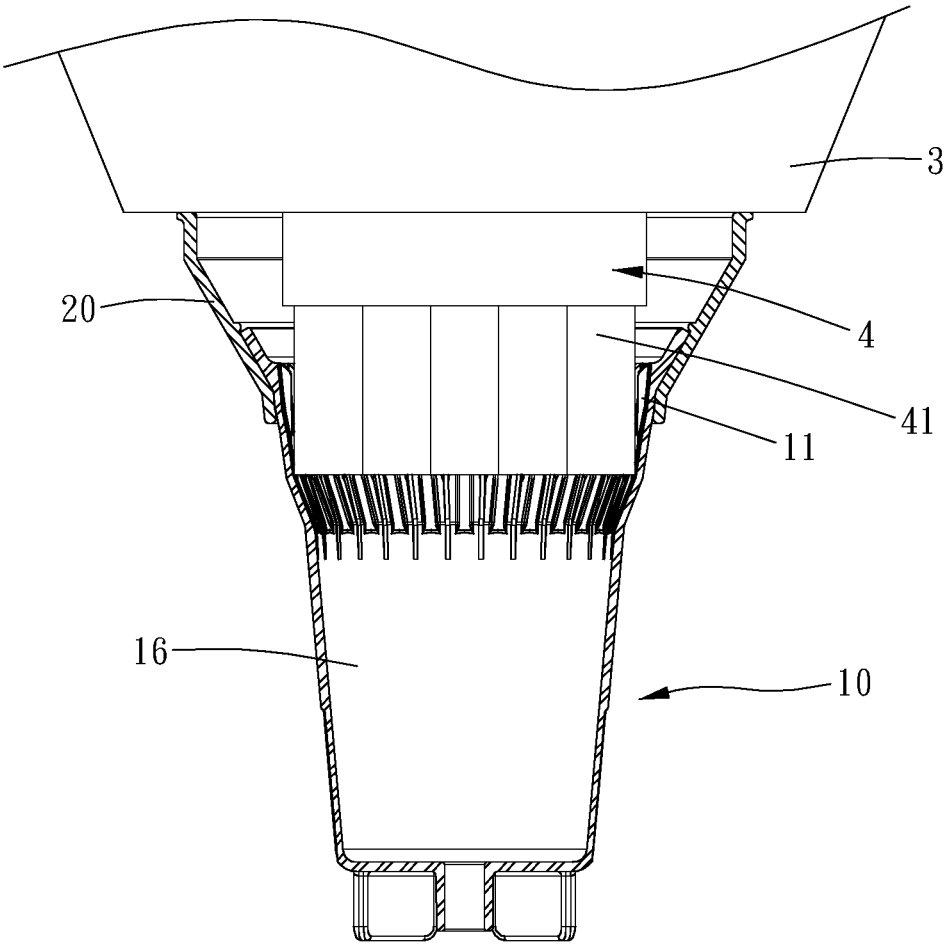
FIG. 5 is a cross-sectional view of FIG. 4.

Please refer to FIGS. 1 to 5 for a preferable embodiment of the present invention. An oil filter removal tool 1 of the present invention is configured for removal of a filter cartridge 4 of a vehicle 3, wherein the filter cartridge 4 includes a driven portion 41. The oil filter removal tool 1 includes a main body 10 and a cover portion 20.

The main body 10 includes a driving portion 11 configured to be connected with the driven portion 41 so that the main body 10 is rotatable with the filter cartridge 4. The cover portion 20 is connected with the main body 10, the cover portion 20 includes an opening 21, the opening 21 corresponding to the driving portion 11, and the opening 21 is configured for assembling of the driven portion 41 of the filter cartridge 4. The main body 10 has a first flexibility, the cover portion 20 has a second flexibility, and the second flexibility is greater than the first flexibility. In this embodiment, the term "flexibility" refers to the degree of deformation under a unit force, and the flexibility may be defined by at least one of factors of material, thickness, rigidity and other physical properties. In this embodiment, the main body 10 and the cover portion 20 are made of different plastic materials which are disposable and provide different degrees of deformation and resistance to deformation. In other embodiments, the main body may be made of metal. Specifically, the main body 10 has lower flexibility relative to the cover portion 20 so that the main body 10 is relatively hard to deform and advantageous for rotation by the hand(s) or a tool (hand tool, electric or pneumatic tool). The cover portion 20 and the main body 10 are made of different materials. Preferably, the cover portion 20 is made of flexible material, which is more flexible so as to prevent gap between the cover portion 20 and the vehicle 3 to avoid leakage of oil.

The main body 10 and the cover portion 20 are detachably sleeved with each other along a first direction L1, the main body 10 includes a first abutting portion 13 extending along a second direction, the cover portion 20 includes a second abutting portion 23 extending along the second direction, the first abutting portion 13 and the second abutting portion 23 are engaged with each other in the first direction L1, and the second direction is lateral to the first direction L1. Preferably, the main body 10 further includes an opened end 14, the opened end 14 includes an inlet 141 in communication with the opening 21 and the first abutting portion 13, the driving portion 11 includes at least one engaging slot 15 in communication with the inlet 141, and the first abutting portion 13 defines the inlet 141. In this embodiment, the first abutting portion 13 may be an annular end plane or an annular protrusive structure, and the second abutting portion 23 is abutted on the first abutting portion 13. The main body 10 includes a first assembling end portion 12, the cover portion 20 includes a second assembling end portion 22 opposite to the opening 21, and the second assembling end portion 22 and the first assembling end portion 12 are detachably sleeved with each other. Preferably, the first assembling end portion 12 includes a first annular inclined surface 121, and the second assembling end portion 22 includes a second annular inclined surface 221 which corresponds to and annularly abuts and the first annular inclined surface 121. Specifically, the cover portion 20 defines a central axis L3 parallel to the first direction L1, the first annular inclined surface 121 is tapered relative to the central axis L3 from the opening 21 in the first direction L1. As a result, the combination of the main body 10 and the cover portion 20 is strong, and the fluid (oil) cannot leak easily between the cover portion 20 and the main body 10.

Specifically, in this embodiment, the driven portion 41 has a non-circular outer circumferential surface, a circumferential surface 151 of each said engaging slot 15 includes a plurality of ribs 152 which are circumferentially arranged in intervals and configured to abut against the filter cartridge 4. In other embodiments, each said engaging slot may match with the driven portion in shape.

The cover portion 20 further includes a guiding portion 24 connected with the second assembling end portion 22, the guiding portion 24 includes the opening 21, the guiding portion 24 includes an outer annular flange 25 projecting radially, and the outer annular flange 25 is configured to be abutted on the vehicle 3, for prevent leakage.

Preferably, the guiding portion 24 is protrusive beyond the first assembling end portion 12, the guiding portion 24 includes a straight section 241 and a tapered section 242. In the first direction L 1, the tapered section 242 is in communication with and between the straight section 241 and the second assembling end portion 22, the tapered section 242 includes a through hole 243, the through hole 243 is tapered from the straight section 241 toward the second assembling end portion 22, and the straight section 241 extends linearly along the first direction L1, which is advantageous for fitting the cover portion 20 to the vehicle 3 to prevent leakage.

The main body 10 further includes a reservoir 16, and the driving portion 11 is located between the reservoir 16 and the opening 21. The reservoir 16, each said engaging slot 15 and the opening 21 are in communication with each other, which allows the leaked fluid, if any, to be guided to the reservoir 16.

In this embodiment, the driving portion 11 defines a first height H1 in the first direction L1, the guiding portion 24 defines a second height H2 in the first direction L1, and a sum of the first height H1 and the second height H2 is larger than or equal to 50.00 mm, wherein the second height H2 is larger than or equal to 15.00 mm. Preferably, the second height H2 is larger than or equal to 20.00 mm so as to sufficiently cover the filter cartridge 4 and effectively abut the vehicle 3, for avoiding leakage.

In this embodiment, the cover portion 20 is pervious to light, and the main body 10 is pervious to light, so the state inside the oil filter removal tool, such as the assembling of the driven portion 41 of the filter cartridge 4 and the driving portion 11, can be observed.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An oil filter removal tool, configured for removal of a filter cartridge of a vehicle, the filter cartridge includes a driven portion, the oil filter removal tool including:

a main body, including a driving portion configured to be connected with the driven portion so that the main body is rotatable with the filter cartridge; and a cover portion, connected with the main body, including an opening corresponding to the driving portion, the opening being configured for assembling of the driven portion of the filter cartridge therewithin;

wherein the main body has a first flexibility, the cover portion has a second flexibility, and the second flexibility is greater than the first flexibility;

wherein the main body includes a first assembling end portion, the cover portion includes a second assembling end portion opposite to the opening, and the second assembling end portion and the first assembling end portion are detachably sleeved with each other;

wherein the first assembling end portion includes a first annular inclined surface, and the second assembling end portion includes a second annular inclined surface which corresponds to and annularly abuts the first annular inclined surface.

2. The oil filter removal tool of claim 1, wherein the cover portion is made of flexible material.

3. The oil filter removal tool of claim 1, wherein the cover portion and the main body are made of different materials.

4. The oil filter removal tool of claim 1, wherein the cover portion further includes a guiding portion connected with the second assembling end portion, the guiding portion includes the opening, the guiding portion includes an outer annular flange projecting radially, and the outer annular flange is configured to be abutted on the vehicle.

5. The oil filter removal tool of claim 1, wherein the cover portion is pervious to light.

6. An oil filter removal, configured for removal of a filter cartridge of a vehicle, the filter cartridge includes a driven portion, the oil filter removal tool including:

a main body, including a driving portion configured to be connected with the driven portion so that the main body is rotatable with the filter cartridge; and a cover portion, connected with the main body, including an opening corresponding to the driving portion, the opening being configured for assembling of the driven portion of the filter cartridge therewithin;

wherein the main body has a first flexibility, the cover portion has a second flexibility, and the second flexibility is greater than the first flexibility;

wherein the main body and the cover portion are detachably sleeved with each other along a first direction, the main body includes a first abutting portion extending along a second direction, the cover portion includes a second abutting portion extending along the second direction, the first abutting portion and the second abutting portion are engaged with each other in the first direction, and the second direction is lateral to the first direction;

wherein the main body further includes an opened end, the opened end includes an inlet in communication with the opening and the first abutting portion, the driving portion includes at least one engaging slot in communication with the inlet, the first abutting portion defines the inlet, and the second abutting portion is abutted on the first abutting portion;

wherein the cover portion is made of flexible material; the main body includes a first assembling end portion, the cover portion includes a second assembling end portion opposite to the opening, and the second assembling end portion and the first assembling end portion are detachably sleeved with each other; the first assembling end portion includes a first annular inclined surface, and the second assembling end portion includes a second annular inclined surface which corresponds to and annularly abuts the first annular inclined surface; the cover portion defines a central axis parallel to the first direction, the first annular inclined surface is tapered relative to the central axis from the opening in the first direction; the second abutting portion is nearer to the opening than the second annular inclined surface; the cover portion further includes a guiding portion connected with the second assembling end portion, the guiding portion includes the opening, the guiding portion includes an outer annular flange projecting radially, and the outer annular flange is configured to be abutted on the vehicle; the guiding portion is protrusive beyond the first assembling end portion, the guiding portion includes a straight section and a tapered section, in the first direction, the tapered section is in communication with and between the straight section and the second assembling end portion, the tapered section includes a through hole, the through hole is tapered from the straight section toward the second assembling end portion, the straight section extends linearly along the first direction; the main body further includes a reservoir, the driving portion is located between the reservoir and the opening; the reservoir, each said engaging slot and the opening are in communication with each other; the main body and the cover portion are made of different plastic materials; the driving portion defines a first height in the first direction, the guiding portion defines a second height in the first direction, and a sum of the first height and the second height is larger than or equal to 50.00 mm; the second height is larger than or equal to 15.00 mm; the cover portion is pervious to light.

* * * * *